US005971865A

United States Patent [19]

Shenoha et al.

[11] Patent Number: 5,971,865

[45] Date of Patent: Oct. 26, 1999

[54] GOLF CLUB WITH OVERSIZE SHAFT

[75] Inventors: James L. Shenoha, Lockport; Carl E. Scheie, Libertyville; Frank Garrett, Jr., Barrington, all of Ill.

[73] Assignee: Wilson Sporting Goods Co., Del.

[21] Appl. No.: 09/008,673

[22] Filed: Jan. 16, 1998

Related U.S. Application Data

[63] Continuation-in-part of application No. 08/381,705, Jan. 31, 1995, abandoned.

[51] Int. Cl.[6] ..... A63B 53/00

[52] U.S. Cl. ..... 473/316

[58] Field of Search ..... 473/305, 306, 473/308, 309, 307, 310, 316, 318, 319, 320, 321

[56] References Cited

U.S. PATENT DOCUMENTS

| | | |
|---|---|---|
| 796,802 | 8/1905 | Brown . |
| 2,363,991 | 11/1944 | Reach . |
| 2,934,345 | 4/1960 | Scott . |
| 3,313,541 | 4/1967 | Benkoczy et al. . |
| 3,410,558 | 11/1968 | Reuter, Jr. . |
| 3,519,270 | 7/1970 | Baymiller . |
| 3,614,101 | 10/1971 | Hunter . |
| 3,843,122 | 10/1974 | Florian . |
| 3,992,015 | 11/1976 | Benson . |
| 3,998,458 | 12/1976 | Inoue et al. . |
| 4,023,801 | 5/1977 | VanAuken . |
| 4,067,573 | 1/1978 | Key, Jr. . |
| 4,097,626 | 6/1978 | Tennent . |
| 4,106,777 | 8/1978 | Kim . |
| 4,122,593 | 10/1978 | Braly . |
| 4,132,579 | 1/1979 | VanAuken . |
| 4,157,181 | 6/1979 | Cecka . |
| 4,272,077 | 6/1981 | Spivey . |
| 4,319,750 | 3/1982 | Roy . |
| 4,455,022 | 6/1984 | Wright . |
| 4,470,600 | 9/1984 | Parente et al. . |
| 4,555,112 | 11/1985 | Masghati . |
| 4,563,007 | 1/1986 | Bayliss et al. . |
| 4,757,997 | 7/1988 | Roy . |
| 4,809,983 | 3/1989 | Langert . |
| 4,892,316 | 1/1990 | Langert et al. . |
| 4,895,368 | 1/1990 | Geiger . |
| 4,984,794 | 1/1991 | Pernelle et al. . |
| 5,004,236 | 4/1991 | Kameshima . |
| 5,018,735 | 5/1991 | Meredith et al. . |
| 5,074,555 | 12/1991 | Meredith . |

(List continued on next page.)

FOREIGN PATENT DOCUMENTS

| | | |
|---|---|---|
| 1961735 | 6/1970 | Germany . |
| 1-30760 | 9/1989 | Japan . |
| 4-15963 | 2/1992 | Japan . |
| 5-177020 | 7/1993 | Japan . |
| 5-53672 | 7/1993 | Japan . |
| 8-89605 | 4/1996 | Japan . |
| 1261541 | 1/1972 | United Kingdom . |
| 2072504A | 9/1981 | United Kingdom . |
| 2237998A | 5/1991 | United Kingdom . |

OTHER PUBLICATIONS

Science and Golf II, Proceedings of the 1994 World Scientific Congress of Golf.

Dien, Sam, "Fairway to Golf Sales", The Sporting Goods Dealer, pp. 68 and 70 (no date).

Petersen's Golfing/Jun., 1994—pp. 30–31.

Golf Digest—"The Shape of Shafts to Come", Golf Digest—pp. 42–43 (no date).

*Primary Examiner*—Steven Wong

*Attorney, Agent, or Firm*—Tilton, Fallon, Lungmus & Chestnut

[57] ABSTRACT

A golf club shaft is provided with increased torsional stiffness by making the outside diameter of the tip end larger. The torsional stiffness per unit weight of the shaft is greater than the torsional stiffness per unit weight of prior shafts. The shaft can be attached to a clubhead by inserting the tip end over a male hosel or over a shaft adapter which is attached to a female hosel.

6 Claims, 9 Drawing Sheets

U.S. PATENT DOCUMENTS 5,093,162 3/1992 Fenton et al. .
5,181,720 1/1993 Stites, III et al. .
5,184,819 2/1993 Desbiolles .
5,192,073 3/1993 Iwanaga et al. .
5,205,552 4/1993 Green, Jr. .
5,253,868 10/1993 Baumann .
5,265,872 11/1993 Tennent et al. .
5,275,408 1/1994 Desbiolles et al. .
5,277,423 1/1994 Artus .
5,294,118 3/1994 Iwanaga .
5,308,062 5/1994 Hogan .
5,310,189 5/1994 Soto .
5,316,299 5/1994 Feche et al. .
5,316,300 5/1994 Simmons .
5,324,033 6/1994 Fenton, Jr. .
5,395,109 3/1995 Fenton, Jr. .
5,421,573 6/1995 Kawamatsu .
5,439,218 8/1995 Gondeck .
5,439,219 8/1995 Vincent .
5,467,984 11/1995 Veux et al. .
5,547,189 8/1996 Billings .
5,569,097 10/1996 Veux et al. .
5,569,098 10/1996 Klein .
5,573,467 11/1996 Chou et al. .
5,573,468 11/1996 Baumann .
5,575,722 11/1996 Saia et al. .
5,792,007 8/1998 Billings .

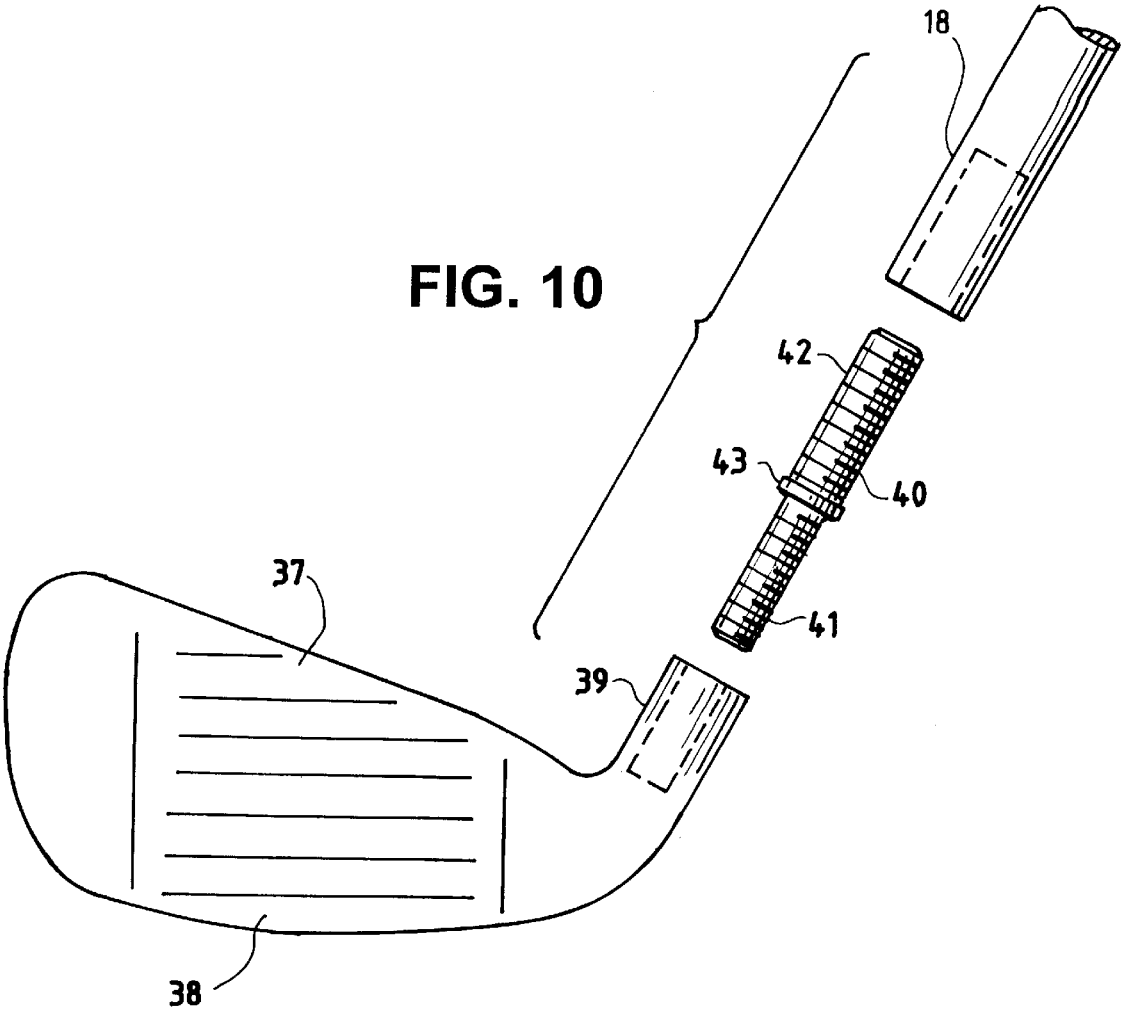
FIG. 10
FIG. 11
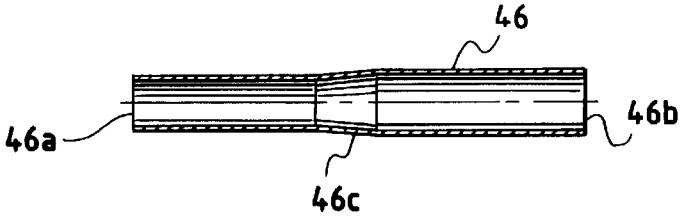
FIG. 12
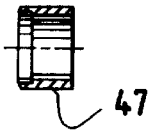

FIG. 17

| SHAFT CHARACTERISTICS | | | | | | | | |
|---|---|---|---|---|---|---|---|---|
| SHAFT DESCRIPTION | WEIGHT [gm] | BALANCE POINT | DEFLECTION @30.0" | FREQUENCY [CPM] | KICKPOINT % FROM TIP | DISPLAC @ KICKP | TIP ANGLE | ROTATION @ 1 ft-lb |
| ALDILA FIRESTICK 1.6 | 108.0 | 20.6 | 2.833 | 322.2 | 50.9% | 0.602 | 8.73° | 1.25° |
| **UST S-FLEX FAT SHAFT** | **79.0** | **18.9** | **3.274** | **291.0** | **55.2%** | **0.611** | **9.48°** | **1.83°** |
| **UST R-FLEX FAT SHAFT** | **77.6** | **18.9** | **3.505** | **281.0** | **55.4%** | **0.658** | **10.11°** | **1.95°** |
| UST FIRESTICK 2.8 TW | 106.0 | 19.3 | 2.739 | 312.8 | 52.7% | 0.574 | 8.61° | 2.18° |
| UST FIRESTICK 3.5 TW | 104.3 | 19.5 | 3.171 | 295.2 | 52.9% | 0.667 | 9.80° | 2.30° |
| UST FIRESTICK 2.8 | 78.5 | 19.8 | 2.695 | 287.0 | 52.4% | 0.553 | 8.35° | 3.37° |
| ADILA HM33 R | 78.7 | 18.8 | 3.236 | 293.2 | 53.6% | 0.632 | 9.50° | 3.55° |
| UST FIRESTICK 3.5 | 76.8 | 19.2 | 3.516 | 274.5 | 53.1% | 0.723 | 10.70° | 3.67° |
| UST FIRESTICK 4.0 | 76.3 | 19.5 | 3.540 | 278.9 | 52.3% | 0.756 | 10.78° | 3.78° |
| UST FIRESTICK 4.5 | 77.2 | 19.4 | 3.663 | 273.2 | 53.0% | 0.768 | 11.03° | 3.80° |
| UST 620 R/S | 81.9 | 20.0 | 3.020 | 313.7 | 52.5% | 0.628 | 9.22° | 3.83° |
| UST 620 A/L | 73.8 | 19.8 | 3.857 | 260.2 | 53.1% | 0.799 | 11.59° | 4.04° |
| TRUE TEMPER DYNAMIC S | 81.0 | 18.3 | 2.944 | 303.6 | 53.3% | 0.581 | 9.12° | 4.05° |
| BRUNSWICK MARK II R | 75.0 | 20.0 | 2.970 | 307.5 | 51.8% | 0.623 | 9.25° | 4.05° |
| ADILA LOW TORQUE 4.0 R | 70.0 | 20.1 | 3.325 | 297.6 | 51.3% | 0.747 | 10.60° | 4.15° |
| RAPPORT SYNSOR R | 78.4 | 19.2 | 3.214 | 285.9 | 52.4% | 0.673 | 9.81° | 4.23° |
| NEO-FIBER R | 87.6 | 18.8 | 3.540 | 274.9 | 53.5% | 0.686 | 10.52° | 4.48° |
| AXON IG193S | 71.3 | 19.2 | 3.103 | 299.7 | 52.1% | 0.673 | 9.62° | 4.53° |
| UST 310 R/S | 68.4 | 19.4 | 3.297 | 297.9 | 52.5% | 0.678 | 9.79° | 4.83° |
| MAIBOR SN-1000-IS | 69.7 | 19.0 | 2.606 | 316.8 | 54.3% | 0.522 | 7.66° | 5.73° |
| MAIBOR GLT-400 IR UT-500 | 66.3 | 19.0 | 3.138 | 275.0 | 54.8% | 0.601 | 9.13° | 5.92° |
| MAIBOR SN-1000-IR | 64.7 | 18.4 | 3.169 | 291.9 | 54.9% | 0.625 | 9.25° | 5.98° |
| MAIBOR SN-1000-IL | 60.4 | 18.4 | 3.679 | 290.2 | 54.8% | 0.731 | 10.73° | 6.10° |

GOLF CLUB WITH OVERSIZE SHAFT

RELATED APPLICATION

This application is a continuation-in-part of U.S. Ser. No. 08/381,705, filed Jan. 31, 1995, now abandonded.

BACKGROUND

This invention relates to shafts for golf clubs, and, more particularly, to a golf club having a shaft which has a greater outside diameter at the tip and increased torsional stiffness.

Torsional stiffness is a measure of the ability of a golf club to resist twisting about the axis of the shaft. During the golf swing, a torsional force is applied to the shaft as the club head rotates about the shaft axis. More importantly, a twisting about the shaft axis occurs during the impact, if a golf ball is struck off-center, resulting in inaccurate shots. If the grip end of a golf club is clamped in a vise, and a torque of one foot-pound is applied to the club head, the angle of rotation of the club head, measured in degrees, indicates the torsional stiffness. This measurement is sometimes referred to as "torque" in golf club technical specifications.

Flex is another physical characteristic of a golf club. Flex is a measurement of the bending that occurs due to the cantilever loading applied to the club during the golf swing. If the butt end of a golf club is clamped in a vise, and a load of 6.5 pounds is applied at the tip, the deflection of the tip, measured in inches, is a measure of flex.

Both torque and flex affect the performance of a golf club. With respect to torque, more shaft rotation during impact results in more side spin being imparted to the ball. With respect to flex, an optimal stiffness exists for a particular shaft and player.

SUMMARY OF THE INVENTION

The invention increases the torsional stiffness of golf shafts while optimizing desired flex, weight, and balance of the shafts. The tip end of the shaft which is attached to the clubhead is made larger than prior shafts to provide increased torsional stiffness.

DESCRIPTION OF THE DRAWING

The invention will be explained in conjunction with the enclosed drawing, in which

FIG. 10 is an exploded view, partially broken away, of the clubhead and adapter of FIGS. 8 and 9 and a shaft;

FIG. 11 is a sectional view of an adapter tube for attaching a shaft to a female hosel;

FIG. 12 is a sectional view of a ferrule which can be used with the adapter tube of FIG. 10;

FIG. 17 compares physical characteristics of two shafts made in accordance with the invention with certain prior art shafts;

DESCRIPTION OF SPECIFIC EMBODIMENTS

Figure 1:
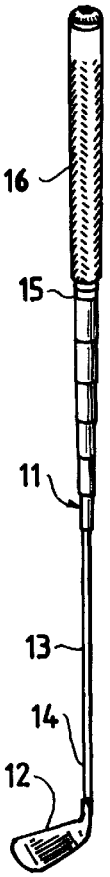
FIG. 1 is a perspective view of a clubhead which is equipped with a shaft in accordance with the invention.

Referring to FIG. 1, a golf club 11 includes a clubhead 12 and a shaft 13. The shaft includes a tip end portion 14 which is attached to the clubhead and a butt end portion 15. A conventional grip 16 is mounted on the butt end portion.

Figure 2:
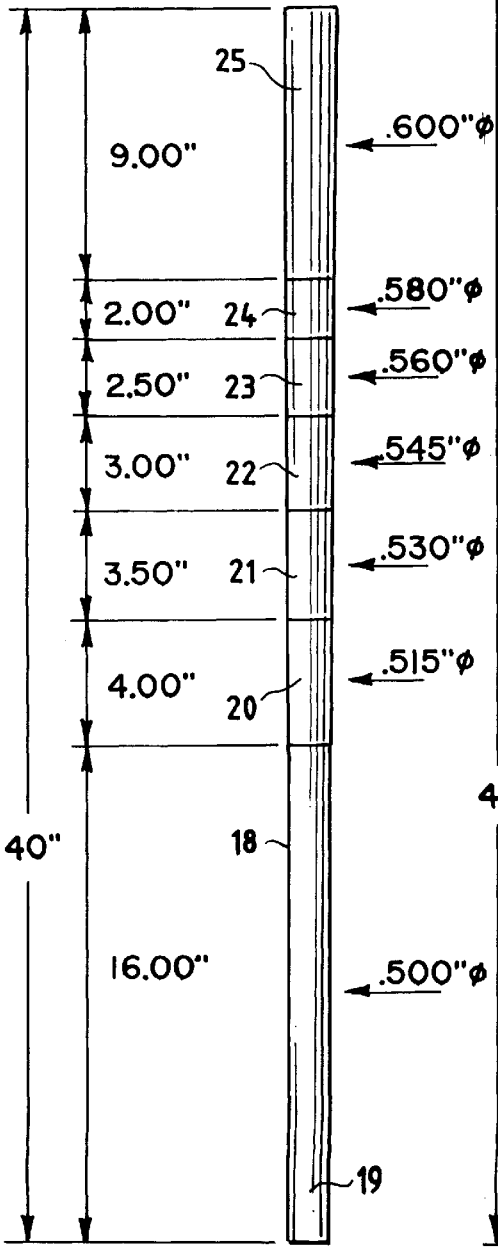
FIG. 2 is an elevational view of a shaft blank for an iron club.

FIG. 2 illustrates a steel shaft 18 which is suitable for use with an iron club. The shaft includes a generally cylindrical tip end portion 19, a plurality of generally stepped portions 20 through 24, and a generally cylindrical butt end portion 25. The inside and outside diameters of each of the shaft portions 19–25 are substantially constant throughout the length of each portion.

The outside diameters of each of the shaft portions is indicated in FIG. 2. The outside diameter of the tip portion 19 is 0.500 inch, and the outside diameter of the butt portion 25 is 0.600 inch. The outside diameters of the stepped portions 20–24 vary from 0.515 to 0.580 inch as indicated. The tolerances for the diameters are preferably ±0.002 inch.

The outside diameter of the butt portion is conventional. However, the outside diameter of the tip portion is substantially larger than the outside diameter of the tip portion of conventional steel shafts, which is typically about ⅜ inch. Preferably, the outside diameter of the tip portion is greater than 0.45 inch, and more preferably at least about 0.500 inch.

Figure 3:
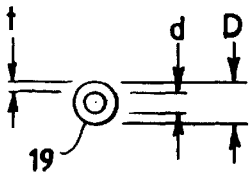
FIG. 3 is a bottom end view of the shaft of FIG. 2.
Figure 5:
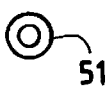
FIG. 5 is a bottom end view of the shaft of FIG. 4.
Figure 7:
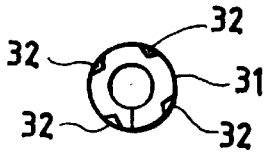
FIG. 7 is an end view of the hosel of FIG. 6 taken along the line 7—7 of FIG. 6.

Referring to FIG. 3, the tip portion has an outside diameter D of 0.500 inch and an inside diameter d of 0.462±0.0025 inch. The wall thickness t of the tip portion is within the range of 0.0175 to 0.020 inch. If the tolerance for the outside diameter is considered, the wall thickness is within the range of 0.0165 to 0.021 inch.

As described in U.S. Pat. No. 4,555,112, increasing the outside and inside diameters of a shaft and decreasing the wall thickness can provide a higher polar moment of inertia without increasing the weight of the shaft. A shaft with a higher polar moment of inertia will twist less and have higher torsional stiffness. However, the particular iron club shaft described in the patent had an outside diameter of 0.355 inch at the tip end 16 and an outside diameter of 0.400 inch at the upper end of the tapered tip portion.

The shaft 18 illustrated in FIG. 2 has a length of 40 inches, which is the standard length of a shaft blank which is used for a set of irons. The length of each of the shaft portions is indicated in FIG. 2. The length of the tip portion is 16 inches, and the length of the butt portion is 9 inches.

The standard shaft length for iron clubs varies from 39½ for a No. 2 iron to 35½ inches for a pitching wedge as shown in Table I.

TABLE I

| Iron | Shaft Length (in.) |
|---|---|
| 2 | 39½ |
| 3 | 39 |
| 4 | 38½ |
| 5 | 38 |
| 6 | 37½ |
| 7 | 37 |
| 8 | 36½ |
| 9 | 36 |
| PW | 35½ |

The shaft of FIG. 2 can be used for all of the irons of a set by cutting only the tip portion 19 or either the tip portion 25 to provide the desired overall example, for a 2 iron, ½ inch is cut from the shaft blank. For a 3 iron, 1 inch is cut from the shaft blank.

The dimensions of the shaft of FIG. 2 were selected to provide the same flex, kick point, and weight as a conventional True Temper Dynamic S 300 steel shaft with a stiff flex. The dimensions of the shaft portions can be changed to provide different flexes, kick points, etc. However, it is desirable to maintain the outside diameter of the tip portion at about 0.500 inches.

As the overall length of the shaft is reduced by reducing the length of the tip portion, the frequency of the shaft changes. If a graduated frequency is desired for all of the clubs of a set, the weight of each of the shafts of the set should be maintained constant.

If desired, different dimensional shafts can be used for each club of a set so that the weight or other properties of the shaft for each club can be selected as desired. For example, if it is desired to make the weight of the shaft for each club the same, then the wall thicknesses of the shafts can be varied so that the weight remains constant as the shaft length decreases. Alternatively, the lengths of the tip, butt, and stepped portions could be changed to maintain a constant weight regardless of shaft length.

Figure 6:
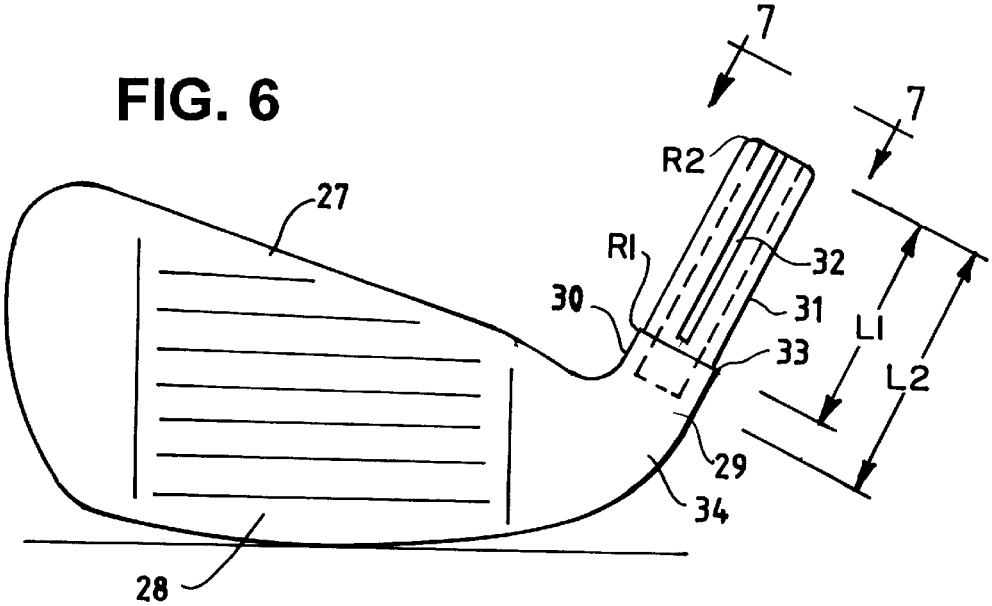
FIG. 6 is an elevational view of an iron clubhead which is adapted to be attached to the shaft of FIG. 2.

FIG. 6 illustrates an iron clubhead 27 which is adapted to be attached to the shaft of FIG. 2. The clubhead 27 includes a conventional blade portion 28 and a hosel 29. However, because the diameter of the tip end of the shaft 18 is larger than conventional shafts, the hosel 29 is adapted to be inserted into the shaft rather than inserting the shaft into the hosel. Hosel 29 may be referred to as a male hosel or a shaft-over hosel.

The hosel 29 includes a lower portion 30 which has an outside diameter substantially the same as the outside diameter of the tip portion 19 and an upper portion 31 which has an outside diameter slightly less than the inside diameter of the tip portion 19. The upper portion is provided with four longitudinal grooves 32 for receiving epoxy which is used to secure the shaft over the hosel. An annular shoulder 33 joins the upper and lower portions of the hosel.

In the particular embodiment illustrated, the outside diameter of the lower portion 30 was ½ inch, and the outside diameter of the upper portion 31 was 0.460 inch +0.000, −0.002.

The outside of the shoulder 33 had a radius $R_1$ of 0.010 inch, and the upper end of the hosel had a radius $R_2$ of 3/32 inch. The length $L_1$ of the upper portion 31 was 1¼ inch, and the length $L_2$ of the hosel between the top of the hosel and the radius at the heel 34 of the clubhead was 1½ inch. The inside diameter of the tubular hosel was ¼ inch. The epoxy grooves 32 were 0.020 inch wide and 0.010 inch deep.

Figure 8:
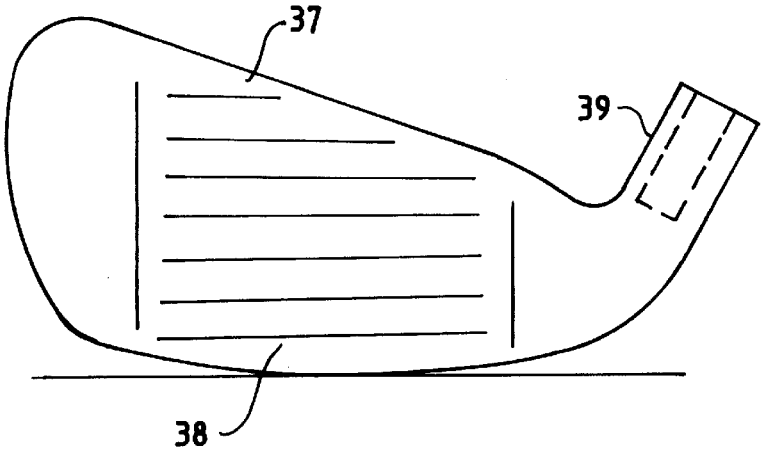
FIG. 8 is an elevational view of another iron clubhead which is adapted to be attached to the shaft of FIG. 2.
Figure 9:
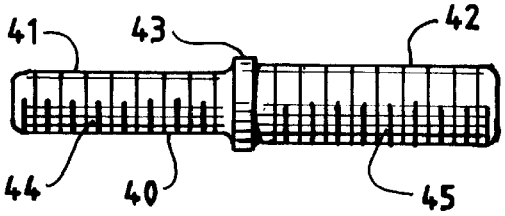
FIG. 9 is a side view of an adapter for attaching a shaft to the clubhead of FIG. 8.

FIGS. 8–10 illustrate an adapter for attaching the shaft 18 to an iron clubhead with a female hosel. A clubhead 37 includes a blade portion 38 and a tubular female hosel 39. The hosel 39 has an outside diameter substantially the same as the outside diameter of the tip portion of the shaft. A shaft adapter 40 (FIG. 9) includes a small diameter portion 41, a large diameter portion 42, and an annular shoulder 43. The diameter of the portion 41 is substantially the same as the inside diameter of the hosel 39, and the diameter of the portion 42 is substantially the same as the inside diameter of the tip portion of the shaft. The diameter of the shoulder is substantially the same as the outside diameters of the tip portion and the hosel.

The adapter portions 41 and 42 are provided with spiral epoxy grooves 44 and 45, and the adapter may also be sandblasted for better epoxy adhesion. The adapter is advantageously formed from titanium, which is strong yet lightweight.

In one specific embodiment, the overall length of the adapter was 2¾ inch, and the lengths of the portions 41 and 42 were 1¼ inch and 1⅜ inch, respectively.

The shaft is attached to the clubhead by coating the end portions 41 and 42 of the adaptor with epoxy and inserting them into the hosel and shaft, respectively.

FIGS. 11 and 12 illustrate another embodiment of an adapter for attaching a shaft with a large tip diameter to an iron clubhead with a female hosel. A stainless steel tube 46 includes first and second ends **46*a* and 46*b* and a flared intermediate portion 46*c*. The outside diameter of end 46*a* is such that the end can be inserted into the female hosel of an iron and secured by epoxy. The outside diameter of end 46*b* is such that the tip end of the shaft 18 can be inserted over the end 46*b*** and secured with epoxy.

The tip end of the shaft butts against the end of the hosel. A ferrule 47 (FIG. 12) can be inserted over the junction between the end of the hosel and the tip end of the shaft to conceal the junction and provide a finished appearance.

Figure 4:
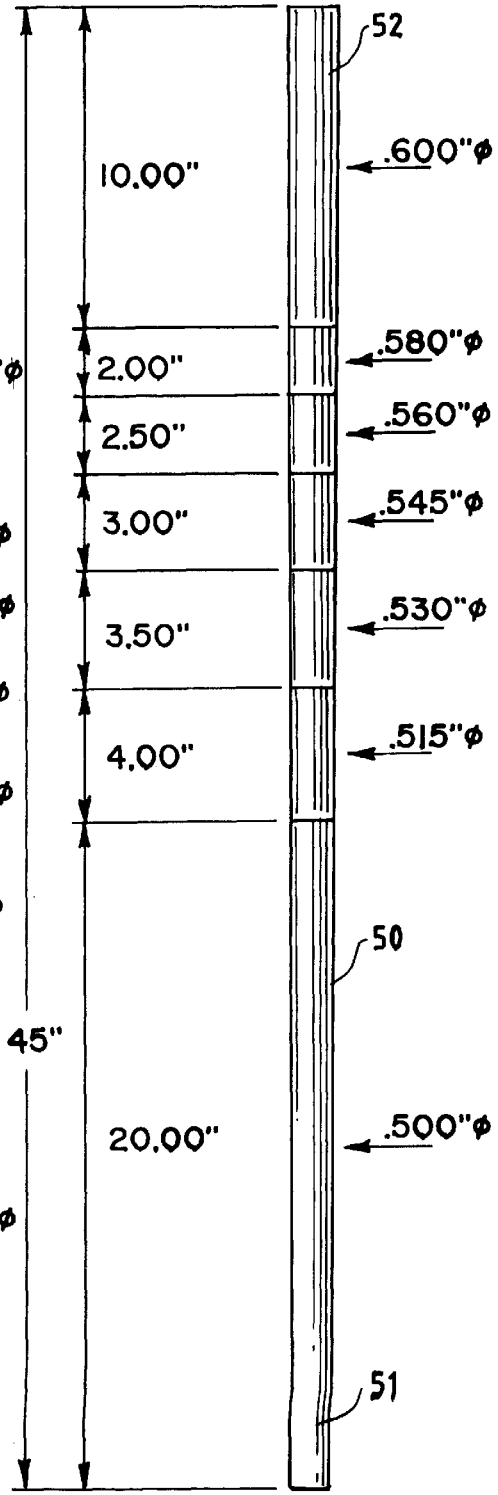
FIG. 4 is an elevational view of a shaft blank for a wood club.

FIG. 4 illustrates a steel shaft blank 50 for a wood-type golf club. The shaft 50 is similar to the shaft 18 except that the overall length of the shaft 50 is 45 inches, and the lengths of the tip and butt portions 51 and 52 are slightly different as indicated in the drawing. The outside and inside diameters of the tip portion 51 are the same as the diameters of the tip portion 19 of the shaft 18.

A set of wood-type clubs can be formed by cutting the tip portion 51 of the shaft 50 to provide the desired overall shaft length for each club of the set. The shaft can be attached to a wood-type clubhead in the same way as described for an iron clubhead. For example, metal woods are conventionally cast with a tubular female hosel. The tip end of the shaft can be inserted into the hosel, or an adaptor like the adapters of FIGS. 9 and 11 can be used. Alternatively, the wood clubhead can be made with a male hosel which is sized to be inserted into the tip end of the shaft.

The particular shafts illustrated in FIGS. 2 and 4 are steel shafts. However, shafts can also be made of other conventional materials such as aluminum, titanium, and composites. Composite materials include fibers, for example, graphite, Kevlar fibers, boron, etc., and resin. Composite materials can also comprise a combination of aluminum and carbide materials, such as silicon carbide and boron carbide.

Shafts made from composite material are generally smoothly tapered from the butt end to the tip.

Figure 13:
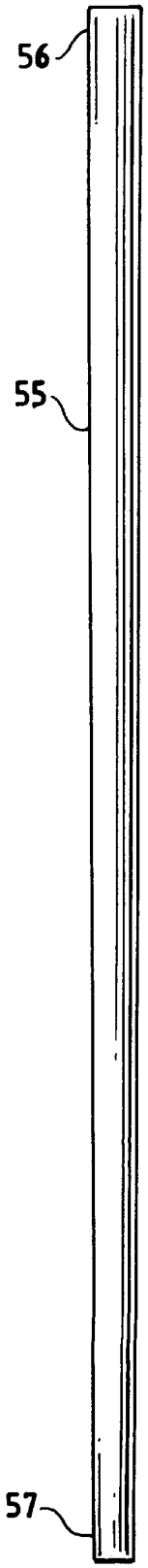
FIG. 13 illustrates a shaft blank formed from composite material which is particularly suited for iron clubheads.

FIG. 13 illustrates a tapered shaft 55 formed from composite material, specifically graphite fibers and resin. In one specific embodiment, the outside diameter of the butt end 56 was 0.600 inch. However, the diameter may vary from 0.560 to 0.620 inch. The outside diameter of the tip end 57 was 0.500 inch. However, the outside diameter of the tip end of a composite shaft can vary within the range of 0.450 to 0.550 inch. The tolerance for composite shafts is ±0.003 inch whereas the tolerance for steel shafts is ±0.002 inch. Shaft blanks for iron clubheads are typically 40 inches and shaft blanks for wood clubheads are typically 47 inches.

Composite shafts can be used with either iron clubheads or wood-type clubheads. However, the outside diameter of the tip end of a composite shaft for use with a wood-type clubhead is generally less than the outside tip diameter of a composite shaft for an iron clubhead, primarily because an iron can include a male hosel while most wood-type clubheads have a female hosel. Specific embodiments of composite shafts for irons with male hosels had an outside tip diameter of 0.500±0.003 inch. Specific embodiments of composite shafts for wood-type clubheads with female hosels had an outside diameter less than 0.500 inch, primarily 0.450±0.003 inch. A 29/64 inch drill bit is 0.453 inch diameter. A shaft having an outside diameter of 0.447±0.003 inch may be conveniently used when the hosel is drilled with a 29/64 inch drill.

Figure 14:
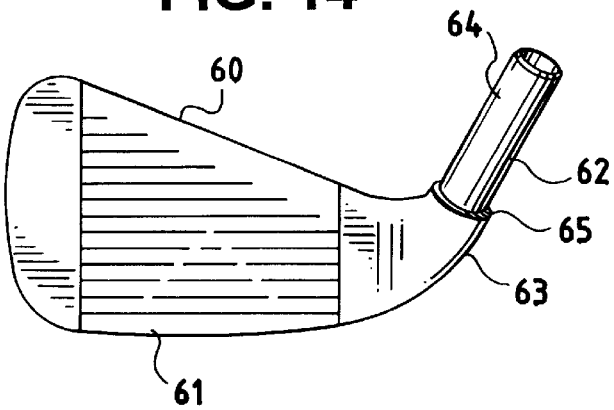
FIG. 14 illustrates an iron clubhead with a male hosel which is adapted for use with either a steel or a composite shaft.

FIG. 14 illustrates an iron clubhead 60 having a blade 61 and a male hosel 62. The hosel 62 includes a lower portion 63, a reduced diameter upper portion 64, and an annular shoulder 65 which joins the upper and lower portions. The clubhead 60 can be used with either metal or composite shafts, and the outside tip diameter of either type of shaft is preferably about 0.500 inch, with a tolerance of ±0.002 inch for steel shafts and ±0.003 inch for composite shafts. However, the outside tip diameter can be greater if desired, for example, up to 0.550 inch. A ferrule similar to the ferrule 47 of FIG. 12 can be used to conceal the junction between the tip end of the shaft and the hosel.

Figure 15:
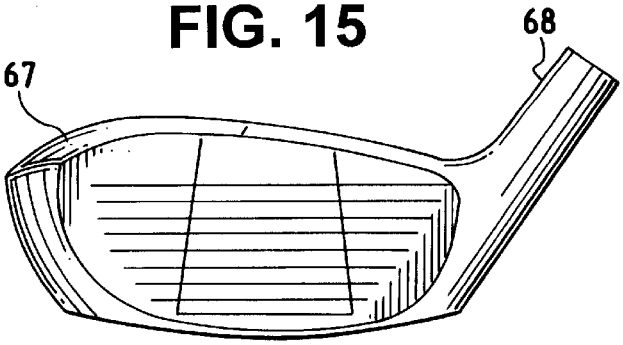
FIG. 15 illustrates a wood-type clubhead with a female hosel which is adapted for use with a composite shaft.

FIG. 15 illustrates a wood-type clubhead 67 which includes a tubular female hosel 68. The clubhead 67 can be used with either metal or composite shafts. The outside tip diameter of the shafts for use with the clubhead 67 is about 0.447 inch to about 0.450 inch, with the appropriate tolerance. However, if the inside diameter of the female hosel can be increased, the outside tip diameter of the shaft can also be increased, for example, up to 0.500 or 0.550 inch.

Figure 16:
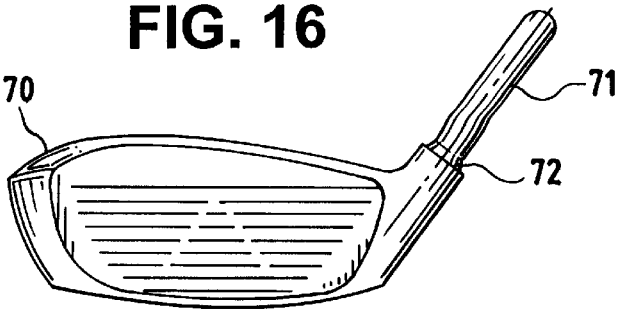
FIG. 16 illustrates a wood-type clubhead with a male hosel which is adapted for use with a composite shaft.

FIG. 16 illustrates a wood-type clubhead 70 with a male hosel 71. An annular shoulder 72 extends radially outwardly from the hosel. The clubhead 70 can be used with either metal or composite shafts. The outside tip diameter of either type of shaft is preferably about 0.500, with the appropriate tolerance of ±0.002 or ±0.003 inch, but the outside diameter can be greater if desired, for example, up to 0.550 inch.

The outside diameter of the hosel is preferably substantially the same as the outside tip diameter of the shaft to provide a smooth junction between the shaft and the hosel. If desired, any discontinuity between the shaft and the hosel can be concealed by a ferrule which fits over the shaft and the hosel.

The terms "iron clubhead," "iron-type clubhead," and "wood-type clubhead" as used herein are intended to refer generically to the two conventional types of golf clubheads and are not meant to refer to the materials from which the clubheads are made. An "iron clubhead" can be made from one or more of a variety of conventional and well known materials, for example, stainless steel, titanium, beryllium, copper, bronze, and fiber and resin composites. A "wood clubhead" can also be made from one or more of a variety of conventional materials, such as wood, stainless steel, titanium, composites, etc.

FIG. 17 compares the physical characteristics of two shafts which are made in accordance with the invention and various prior art shafts. The two shafts of the invention are UST S-Flex FAT Shaft and UST R-Flex FAT Shaft. Both of those shafts are composite shafts made from graphite fibers and resin and have an outside tip diameter of 0.500±0.003 inch.

The data in FIG. 17 was obtained from shafts which were 37 3/16 inches long which were prepared for a Wilson Staff Ultra No. 5 iron.

Torsional Stiffness is measured by clamping 2¼ inches of the tip end of the shaft in a stationary clamp and clamping 2¼ inches of the butt end of the shaft in a rotating clamp. Torque is applied by rotating the butt clamp, and twist angle readings are taken at every foot-pound of torque. The value of Torsional Stiffness is in degrees per foot-pound, and the right hand column in FIG. 17 lists the Torsional Stiffness of the shafts under the heading "Rotation @ 1 ft.-lb.".

Deflection at 30.0 inches is measured by securing the shaft horizontally on a conventional Aldila board which holds the butt end horizontally in a cantilever fashion. A weight of 6½ pounds is hung on the tip end of the shaft, and the deflection in inches at a point 30 inches from the butt end is measured.

Frequency is the natural frequency of vibration of the shaft when clamped at the butt end with a 284 gram weight at the tip.

Kickpoint is measured by compressing the ends of the shaft by forces which are aligned with the axis of the shaft, determining the point of maximum deflection of the shaft from the original axis, and measuring the distance of that point from the tip end as a percentage of the total length of the shaft.

Displacement at Kickpoint is the amount of maximum deflection in inches during the Kickpoint measurement.

Tip Angle is measured at the same time as Deflection at 30.0 inches. Tip Angle is the included angle between the tip end of the shaft and the horizontal.

Weight is the weight of the shaft in grams.

Balance Point is the center of gravity of the shaft or the point measured from the tip end where the shaft balances on a fulcrum.

FIG. 17 indicates the excellent torsional stiffness of the two "FAT Shaft" shafts of the invention. Those two shafts had the lowest torsional stiffness, i.e., the least rotation at one foot-pound of torque, of all of the shafts except the Aldila Firestick 1.6. However, the Aldila Firestick 1.6 weighed 108.0 grams, whereas the Fat Shaft shafts weighed only 79.0 and 77.6 grams, respectively. The torsional stiffness per unit weight of each of the Fat Shaft shafts is therefore substantially higher than the Aldila Firestick 1.6. In other words, the shafts of the invention achieve their resistance to twisting with far less material than prior art shafts.

Figure 18:
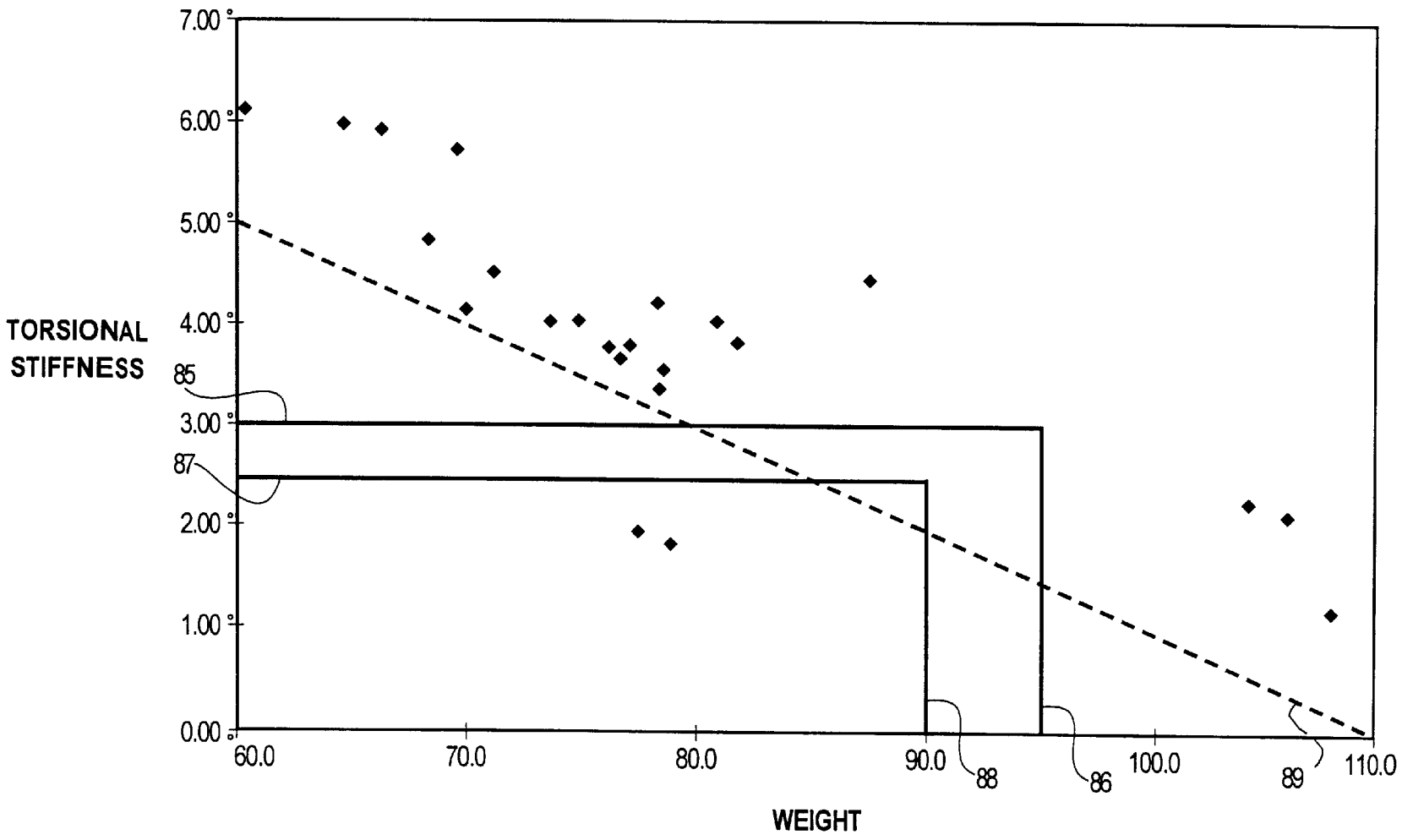
FIG. 18 is a plot of the torsional stiffness versus weight of the shafts of FIG. 17.

FIG. 18 plots the Torsional Stiffness versus weight of the shafts of FIG. 17. All of the shafts except the two Fat Shaft shafts have either a Torsional Stiffness of greater than 3.00°/ft.-lb. or a weight of greater than 95.0 grams. Shafts made in accordance with the invention lie within the lower left portion of the graph. This portion can be described as being bounded by the horizontal line 85 at 3.00° and the vertical line 86 at 95.0 grams. In other words, such shafts have a Torsional Stiffness of less than 3.00° per foot-pound and a weight of less than 95.0 grams. More preferably, the inventive shafts lie within the smaller area of the graph bounded by the horizontal line 87 and the vertical line 88, i.e., the shafts have a Torsional Stiffness of less than 2.5° per foot-pound and a weight of less than 90.0 grams.

Alternatively, the inventive shafts lie within the lower left triangular area of the graph which is bounded by the dashed line 89 which slopes downwardly from 5.0° at 60.0 grams to 0° at 110 grams. The line is defined by the equation $y=-x/10+11$, where y is Torsional Stiffness in degrees/ft.-lb. and x is weight in grams. The Torsional Stiffness of the inventive shafts is therefore less than −x/10+11.

The Specific Torsional Stiffness of a shaft can be determined by dividing the Torsional Stiffness by the weight of the shaft. The inventive shafts have a higher Specific Torsional Stiffness than the Aldila Firestick 1.6 shaft. For example, the UST S-Flex Fat Shaft of FIG. 17 has a Specific Torsional Stiffness of 1.83/79=0.023°/ft.-lb./gram. The Aldila Firestick 1.6 has a lower Torsional Stiffness, but, since the shaft is much heavier, has a Specific Torsional Stiffness of only 1.25/108=0.012°/ft.-lb./gram.

Figure 19:
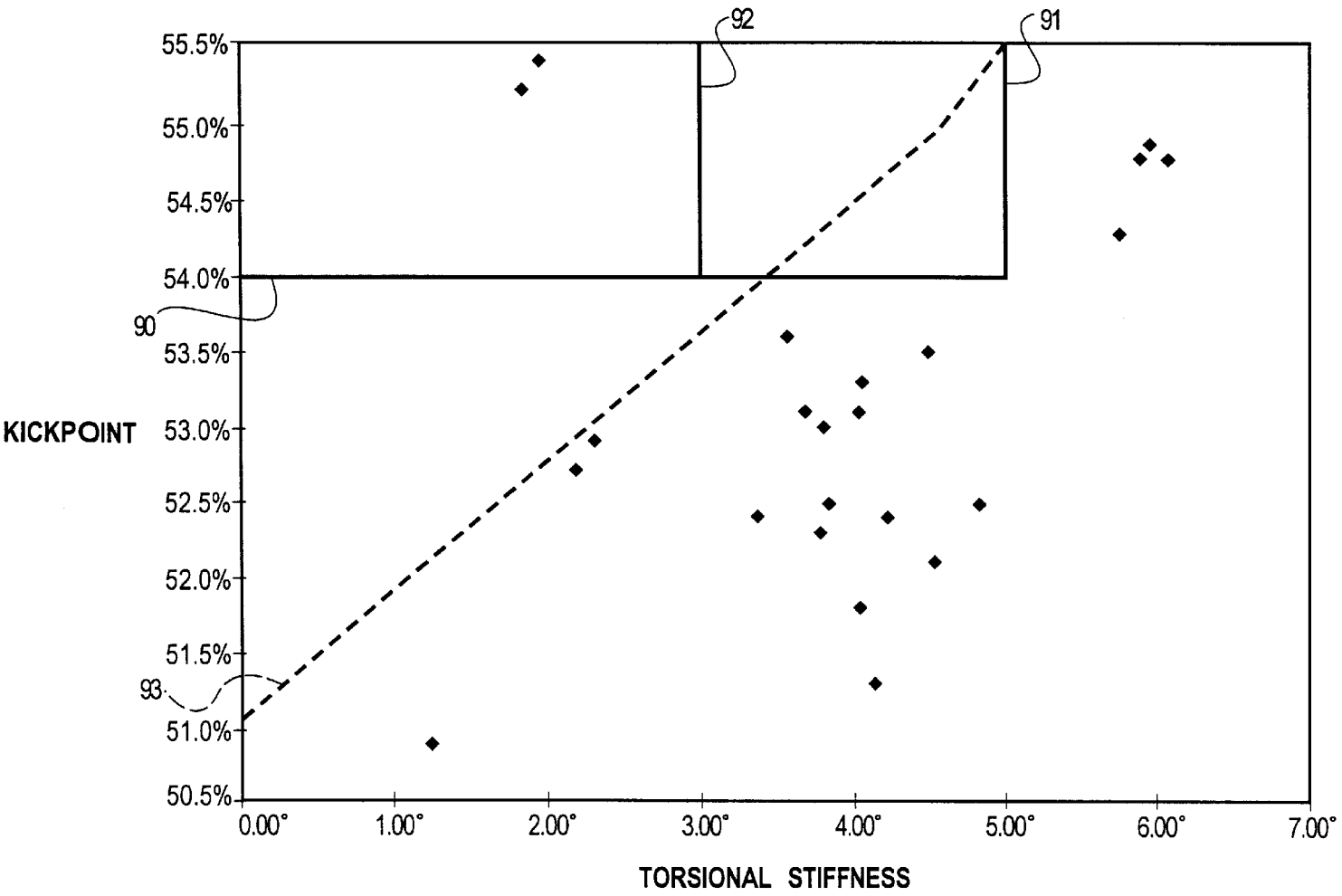
FIG. 19 is a plot of the kickpoint versus torsional stiffness of the shafts of FIG. 17.

FIG. 19 plots the Kickpoint versus Torsional Stiffness of the shafts of FIG. 17. Shafts made in accordance with the invention lie within the upper left portion of the graph. This portion can be described as being bounded by the horizontal line 90 and the vertical line 91. In other words, such shafts have a Torsional Stiffness of less than 5.0° per foot-pound and a Kickpoint of greater than 54.0%. More preferably, the inventive shafts lie in the area of the graph bounded by the horizontal line 90 and the vertical line 92 at 3.0°.

Alternatively, the inventive shafts lie within the upper left triangular area of the graph which is bounded by the dashed line 93 which slopes upwardly from 51.0% Kickpoint at 0.0° to 55.5° Kickpoint at 5.0°. The line is defined by the equation $y=0.9x+51$, where y is Kickpoint in % from tip and x is Torsional Stiffness in degrees/ft. lb. The kickpoint of the inventive shafts is therefore greater than 0.9x+51.

All of the shafts in FIG. 17 have an outside tip diameter of less than 0.447 inch except for the two Fat Shaft shafts. Both steel and composite shafts which have an outside tip diameter of greater than or equal to 0.447 and which are formed in accordance with the invention lie within the area of the graph of FIG. 18 which is bounded by the lines 85 and 86 or below the dashed line 89 and within the area of the graph of FIG. 19 which is bounded by the lines 90 and 91 or above the dashed line 93.

Figure 20:
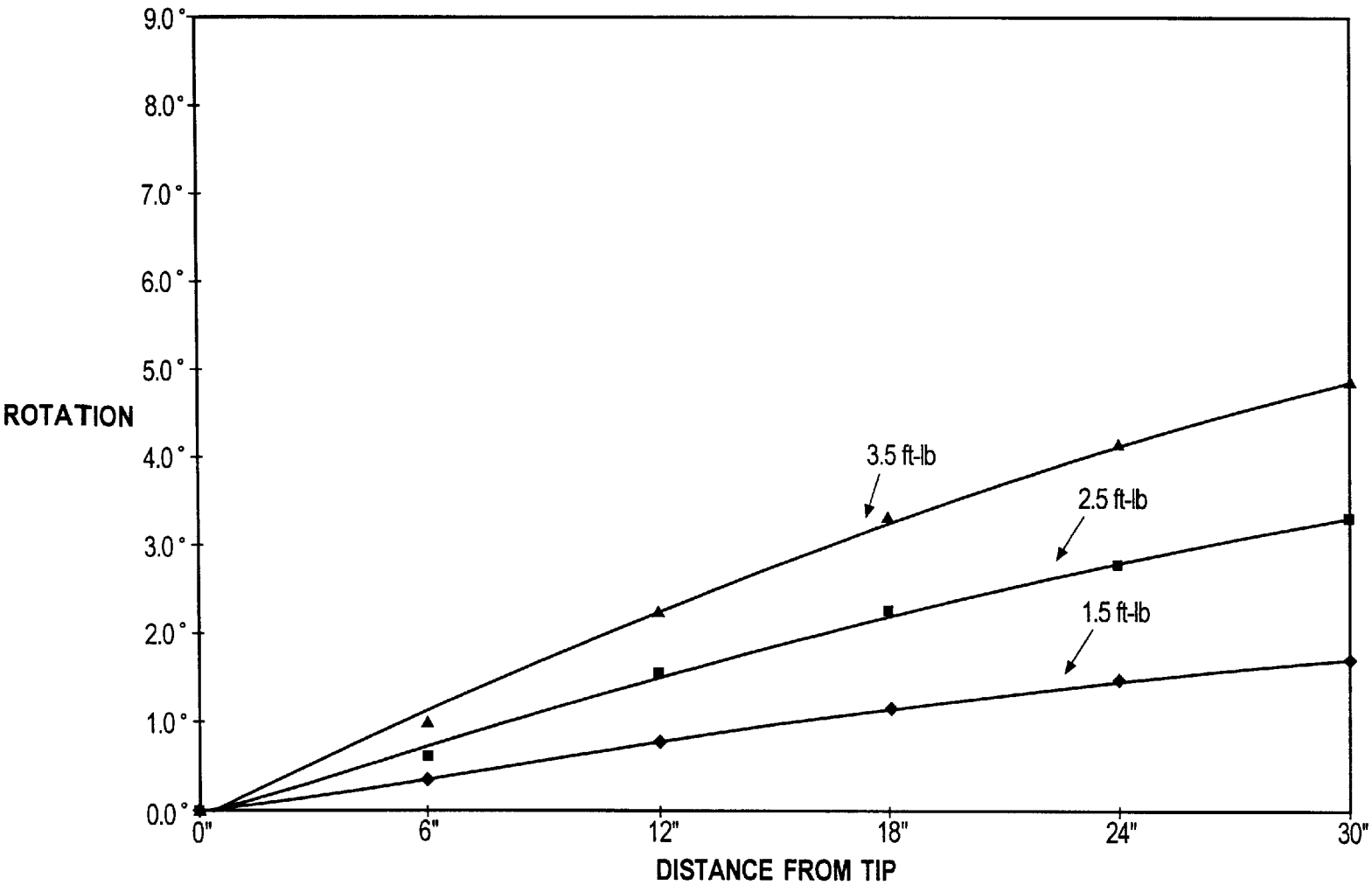
FIG. 20 illustrates the torsional stiffness profile of a shaft made in accordance with the invention.
Figure 21:
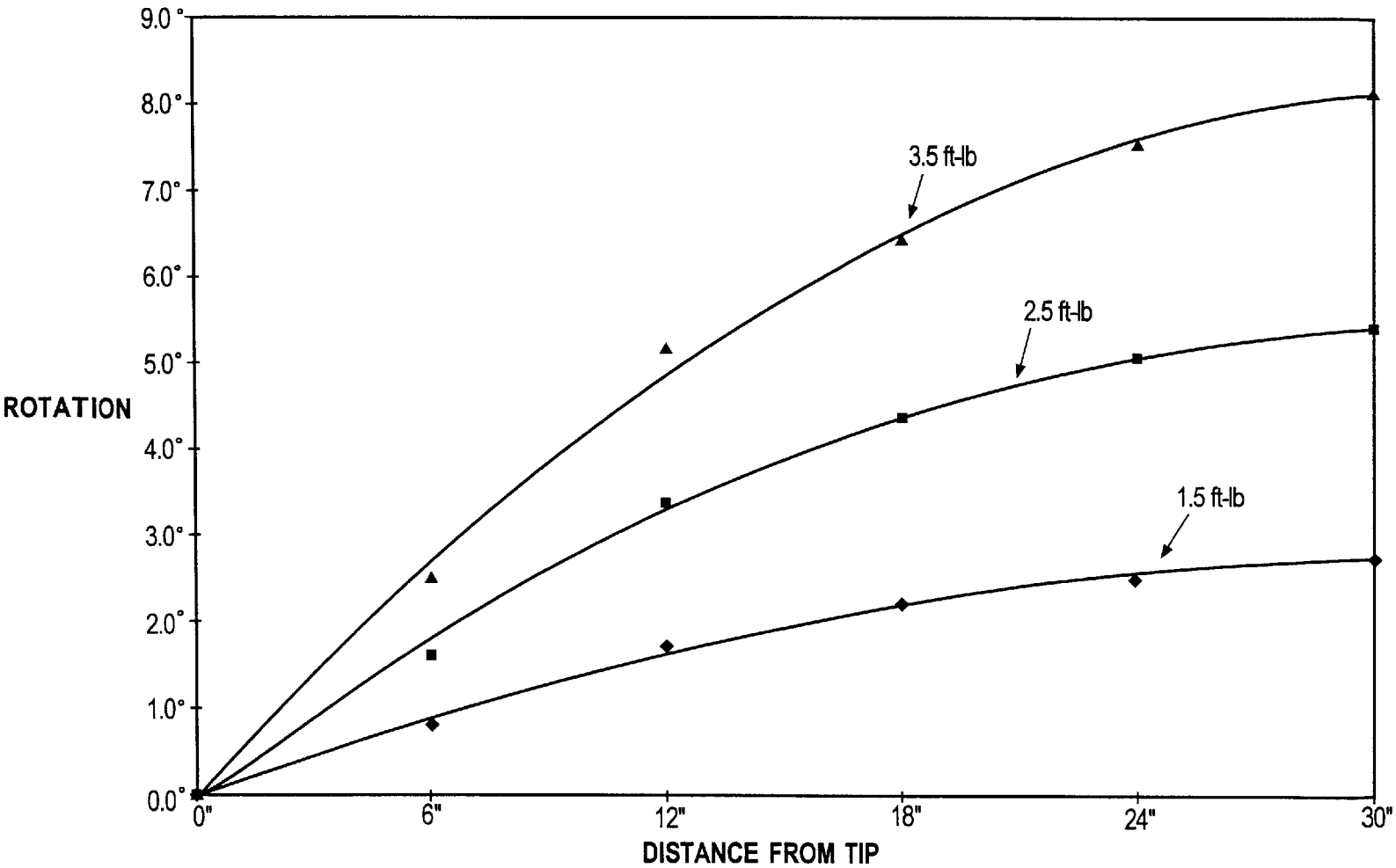
FIG. 21 illustrates the torsional stiffness profile of a prior art shaft.

FIG. 20 illustrates the Rotation of a graphite composite shaft made in accordance with the invention at torque levels of 1.5, 2.5, and 3.5 foot-pounds. FIG. 21 illustrates the Rotation of a prior art graphite composite shaft at the same torque levels. Rotation was determined by the equipment which was used to measure the Torsional Stiffness. A specific torque is applied to the butt end clamp, and Rotation or twist angle is read at distances of 6, 12, 18, 24, and 30 inches from the tip.

The slopes of the curves in FIG. 21 start off relatively steeply at the tip, but at 30 inches from the tip the slopes are very flat and substantially horizontal. Most or all of the rotation of the prior art shaft therefore occurs within the first 30 inches of the shaft.

In contrast, the slopes of the curves of the inventive shaft in FIG. 20 are much flatter throughout the first 30 inches of shaft length, and the curves are still rising at 30 inches. Much less rotation occurs near the tip of the inventive shafts. For example, under a torque of 3.5 ft.-lbs. the rotation at a distance of 6 inches from the tip is less than 2.0°.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. An iron-type golf club comprising an iron-type clubhead and a shaft, the clubhead having a generally cylindrical male hosel having an outside surface, the shaft having a generally cylindrical tip portion at a first end and a butt portion at a second end, the tip portion of the shaft extending over the outside surface of the male hosel and having an outside diameter of at least about 0.498 inch, the shaft having a Torsional Stiffness, Weight and Kickpoint such that a shaft having a length of 37 3/16 inches has a Torsional Stiffness of less than 2.50°/ft.-lb., a Weight of less than 90.0 grams, and a Kickpoint of greater than 54.0%.

2. The golf club of claim 1 in which the shaft when clamped at the tip and tested for Torsional Stiffness and subjected to a torque of 3.5 ft.-lbs., has a Rotation at a point distance of 6 inches from the tip clamp of less than 2.0°.

3. An iron-type of golf club comprising an iron-type clubhead and a shaft, the clubhead having a generally cylindrical hollow female hosel and a shaft adapter inserted in the hosel and extending therefrom, the shaft having a generally cylindrical tip portion at a first end and a butt portion at a second end, the tip portion of the shaft extending over the shaft adapter and having an outside diameter of at least about 0.498 inch, the shaft having a Torsional Stiffness, Weight and Kickpoint such that a shaft having a length of 37 3/16 inches has a Torsional Stiffness of less than 2.50°/ft.-lb., a Weight of less than 90.0 grams, and a Kickpoint of greater than 54.0%.

4. The golf club of claim 3 in which the shaft when clamped at the tip and tested fr Torsional Stiffness and subjected to a torque of 3.5 ft.-lbs., has a Rotation at a point distance of 6 inches from the tip clamp of less than 2.0°.

5. A golf club comprising a clubhead and a shaft, the clubhead including a hosel portion, the shaft having a generally cylindrical tip portion at a first end and a butt portion at a second end, the tip portion of the shaft being secured to the hosel portion of the clubhead, the tip portion having an outside diameter of at least 0.447 inch and the butt portion having an outside diameter greater than the outside diameter of the tip portion, the shaft having a Torsional Stiffness, Weight and Kickpoint such that a shaft having a length of 37 3/16 inches has a Torsional Stiffness of less than 2.50°/ft.-lb., a Weight of less than 90.0 grams, and a Kickpoint of greater than 54.0%.

6. The golf club of claim 5 in which the shaft, when clamped at the tip and tested for Torsional Stiffness and subjected to a torque of 3.5 ft.-lbs., has a Rotation at a point distance of 6 inches from the tip clamp of less than 2.0°.

* * * * *